US005529290A

United States Patent [19]

Drager

[11] Patent Number: 5,529,290

[45] Date of Patent: Jun. 25, 1996

[54] APPARATUS FOR QUENCHING COIL SPRINGS TO ASSURE COOLING

[76] Inventor: Barry Drager, 7042 Long Dr., Houston, Tex. 77087

[21] Appl. No.: 397,778

[22] Filed: Mar. 3, 1995

[51] Int. Cl.[6] ..... C21D 1/63; C21D 1/667

[52] U.S. Cl. ..... 266/114; 266/130; 266/131

[58] Field of Search ..... 148/908, 580; 266/114, 130, 131

[56] References Cited

U.S. PATENT DOCUMENTS 1,595,803 8/1926 Merten ..... 266/131

1,731,923 10/1929 Eaton ..... 148/580

*Primary Examiner*—Deborah Yee

*Attorney, Agent, or Firm*—Gunn & Associates

[57] ABSTRACT

A method and apparatus for controlled quenching of hot formed coils is desccribed, and has a timed dip on a wand connected to a pump. The wand delivers quench liquid into the coil to prevent bubbles from forming in the coil, damaging the coil from irregular quenching.

17 Claims, 1 Drawing Sheet

APPARATUS FOR QUENCHING COIL SPRINGS TO ASSURE COOLING

BACKGROUND OF THE DISCLOSURE

The present disclosure is directed to a system and also a method for treating coil springs for cooling. In the fabrication of a coil spring, it is necessary to form the spring by working the metal of the spring at an elevated temperature, and indeed, at a temperature level where the spring is heated to a cherry red glow. The cherry red glow signifies heating to the requisite level so that the spring can then be shaped to a requisite coil size. The spring is bent in the form of a helix. The helix has a diameter which is dependent on the specifications for the spring winding process. In addition to that, the loops or bights which makeup the helix are defined by the spacing which is necessary for the spring to be wound in the spring winding apparatus. There is a small helical gap between adjacent bights or turns of the spring.

The gap bears a substantial relationship to the diameter of the spring and the stock material used in forming the spring. Springs are normally wound of bar stock, but occasionally are wound from non-round stock. In either instance, the stock before winding has a specified cross sectional area which is heated to the very core of the bar stock so that bending to form a multiple loop coil spring provides something of a barrier to cooling. When dipped in cooling oil as part of the spring winding process, the oil must flow through the bights of the spring to the interior. Where the gap between turns is great, the gap readily admits a flow of liquid coolant into the central part of the coil spring. If the spacing is substantial between adjacent loops of the spring, the rate of flow into this area or region is quite high and cooling of the cherry red coil spring is accomplished with uniform exposure on all sides of the bar stock defining the newly made spring. On the other hand, if the gap is relatively narrow or the spring is quite long in comparison with its diameter, there is a significant time lag in the rate of introduction of coolant into the interior of the spring.

This flow to the interior is essential for uniform cooling. By uniform, the cooling that is actually accomplished must cool the different sides or faces of the coil spring at a rate and location enabling the stock to be cooled on all sides substantially and instantaneously. If the number of turns defines a long spring in comparison with the diameter of the spring and if the gap between adjacent bights is relatively narrow, even cooling at the interior regions of the coil spring does not occur. When the cherry red, partly fabricated spring is plunged into a bath of coolant, there is a violent boiling reaction in which bubbles are instantaneously formed. The bubbles are dynamically formed so that there is no cooling at the interior of the coil spring. In the absence of such cooling, the bar stock making up the bights of the fabricated spring are cooled on the exterior side, but they are not cooled at the interior, meaning they are not cooled at the inside face. The term "inside face" will be used hereinbelow to refer to and identify that side of the individual bights which makes up the inside wall of the spring which is typically pressed against a support mandrel shaping the spring. The spring is supported on the winding mandrel thus defining the inside face. It is in that region where cooling is inadequate. Cooling is terribly delayed in contrast with the outer face, meaning the face that is exposed on the exterior of the completed spring. If there is a substantial time lag between cooling at the inside and outer faces, damage is inflicted by this time lag and the spring will not operate effectively or endure vigorous use.

The present disclosure overcomes this problem. A pump operated lance is connected so that a deluge of coolant is interjected against the inside face of the spring. Moreover, this deluge is able to cool from the inside face so that it is quenched at the same rate as the outer face of the coiled spring. This helps cool the helically wound bar stock at a more even rate, especially when speaking of the inside face and outer face. In one aspect of the present disclosure, the violent boiling phenomena which occurs when the spring is first quenched creates a bubble which is shaped approximately equal to or the same as the interior volume of the coiled spring. The present disclosure is directed to a pump and lance support system which delivers flow in that region so that the liquid void resultant from violent boiling is filled. Equally importantly, the lance that supports the coil spring is able to hold the coil spring so that it is positioned in a specified angular relationship to the bath of coolant. The coolant bath is caused to flow in a particular direction within the bath container. This is typically an open top tank in which the coolant quenches the cherry red heated metal spring. There is a directional flow in the tank so that this flow pattern helps fill the cylindrical void that might otherwise occur when quenching occurs.

Considering now certain aspects of the method of the present disclosure, a coil spring is wound to form a number of turns such as 5 to 50 turns (as an example) supported on a mandrel. Moreover, the several turns connect in such a way that liquid cooling at the inside interface is prevented or at least delayed. In particular, the system of the present disclosure helps deliver coolant for quenching to the interior of the coil spring, namely, to that region which is normally a bubble or void, harmful to the product not yet finished. The finished spring has the same form when it is a properly quenched coil spring. Without the method and apparatus set forth by the present disclosure, it has been difficult and typically impossible to obtain properly a fabricated coiled spring.

Summarizing very briefly, the present disclosure sets forth an overhead hoist which has a positive displacement double acting cylinder which extends downwardly toward the bath of coolant. It supports an elongate lance connected with a header and flexible hose to deliver coolant liquid from a pump. Moreover, the coolant is delivered through the lance through a set of holes which adequately deliver the coolant flow volume from the lance. The lance is perforated but not on the full length of the lance. Rather, the lance is perforated along the length of the lance sufficient to position holes inside and parallel to the coil spring. The coil spring is rested on the lance above the tank. The hydraulic cylinder is operated, moving the piston and extending the piston rod. This operates a first switch which starts the pump operating and delivers coolant liquid flow through the hose and into the lance. In addition to that, a second switch is operated which stops downward travel at a location at which the coiled spring is fully submerged in the tank. In this location the coil spring is quenched. It is completely quenched on both the inside face as well as the outer face. Quenching is accomplished by the method of the present disclosure so that heat reduction is accomplished at substantially the same instant on the inside face as well as the outer face. After a required interval, the hydraulic cylinder is operated to retract, raising the lance and thereby permitting the coil spring to be removed from the coolant bath.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

Figure 1:
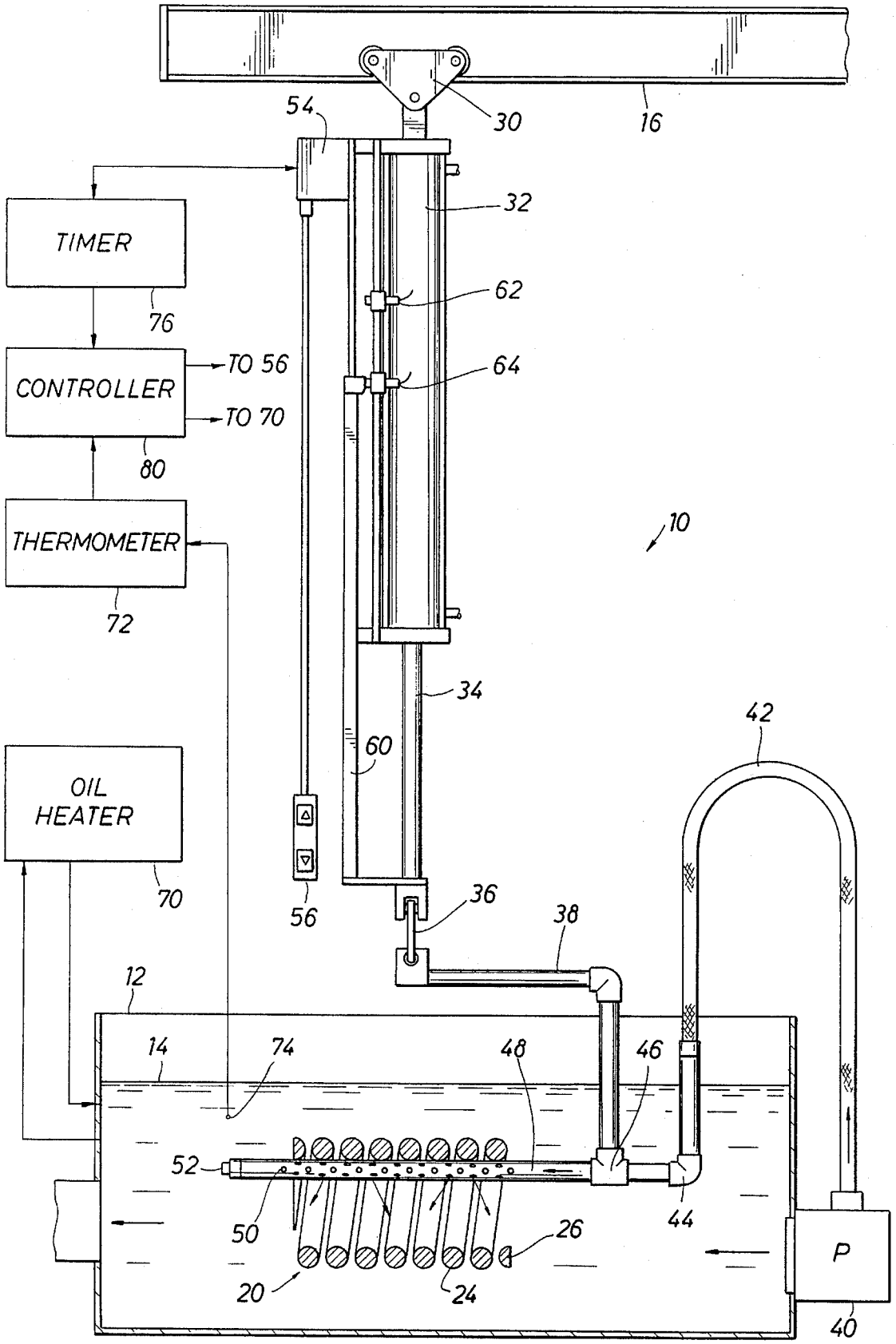

The only view sets forth, with the present disclosure, an apparatus for cooling a coil spring in a bath wherein the coil spring is rested on a lance, is lowered in the bath, and coolant is delivered through a flexible hose connected with the lance.

DETAILED DESCRIPTION OF THE PREFERRED EMBODIMENT

Attention is now directed to FIG. 1 of the drawings which shows a coil spring cooling system 10 which operates over a bath 12 filled with a suitable coolant liquid 14. Commonly, the coolant bath 14 is cooling oil which is able to be heated to relatively high temperatures without substantial loss due to vaporization. This equipment is located beneath an overhead frame member 16 which supports the apparatus 10. It is used to cool partly finished springs fabricated into multiple turn springs. A representative spring 20 is positioned in the bath 14 for cooling.

To set the stage, mention must be made first of the coil winding procedure. An elongate bar of suitable metal is heated in a furnace to a cherry red temperature. The precise temperature is the temperature necessary to obtain the necessary heating. Typically, it is in excess of about 1400° or 1500° F. The precise target temperature is dependent on the metal alloy of the coil spring. The coil spring is wound with N turn where N is a positive number. The number of turns can vary so that the completed coil spring may have a number of turns which is within a wide range. The coil spring is formed of bar stock and has a cross sectional area 24 as illustrated in the drawing. In this particular instance, the bar stock is round and the spring is formed with bights which are made from round stock and which remain round. It may require that the end of the spring is flattened somewhat at the end face 26. This face may be formed at different stages in the processing. Thus, it may not be formed until after quenching in some procedures. In other procedures, it is formed on the coil spring 20 at a different point in the manufacturing process. This process applies whether face 26 is formed before or after quenching.

The cross sectional area shows the shape of the spring stock material. To pick a simple example, assume that this material is one inch in diameter. It is wound into a number of bights which have been wound to a requisite spring diameter. This is the diameter of the spring bights. Further, the bights defining the spring diameter are spaced at a requisite spacing. In the relaxed stage, the helical gap between the turns is sometimes known as the lead of the spring. In some instances, it is known as the pitch of the spring. Assume for purposes of description that the pitch of the spring forms a sufficient number of turns in the fabrication of the spring 20 so that the gap between adjacent bights is relatively narrow in comparison with the size of the spring bar stock, referring especially to that cross sectional area 24. In that instance, it is difficult for coolant in the bath to flow between adjacent bights and thereby accomplish cooling at the inside face at the same instance as the outer face. This is a source of defects in spring manufacture. As a matter of explanation or at least reasonably sound conjecture, it is believed that the formation of a bubble during quenching forms an internal void in the spring when placed in the coolant bath. By contrast, the outer face is in contact with the liquid coolant. The inside face is shielded by this bubble. Coolant contact against the spring at this moment is substantially limited to the outer face. The inside face is generally protected by the bubble formed upon initial submerging of the cherry red hot coil spring with the coolant bath.

As a representative example, when the coolant bath cannot flow through the adjacent gaps between turns of the partially finished coil spring, cooling does not occur in that region and cooling is thwarted, even delayed. When delayed, cooling of the cherry red hot bar stock making the coil spring 20 is accomplished unevenly meaning that the coils are cooled at the outer face but cooling at the inside face is either not done or is done unevenly.

When the foregoing problem occurs, the regular quenching in a drop of perhaps 1000° F. then creates problems. The metal in the bar stock, having been cooled unevenly, becomes more readily brittle at certain regions. This seems to be a direct result of the uneven cooling just mentioned and poses a serious problem in subsequent handling and care of the coil spring. When this occurs, the coil spring will fatigue more rapidly and will break quickly, thereby damaging the equipment in which the spring is installed. Catastrophic failure readily follows this kind of difficulty in quenching.

Going to the apparatus shown in the single drawing, a trolley 30 travels on an overhead frame member 16 for ready movement into a position to the side of the bath 12. It also moves to a position over the bath 12 as shown in the drawings. It supports a double acting hydraulic cylinder 32 which encloses a piston (not shown) which powers a piston rod 34. It is a double acting system so that the piston rod is pulled upwardly and downwardly under power. The piston rod supports a pivoting link 36 at the lower end which permits a U-shaped support bracket to be hung under the piston rod. This bracket is identified generally at 38 and provides a U-shaped support so that the coil spring is supported on it.

A pump 40 is operated to create a flow of coolant in the direction of the arrows within the coolant liquid 14. It flows lengthwise along the elongate container. The pump forces the flow from right to left so that it moves along the central axis of the coil spring 20. The pump has an additional outlet which delivers flowing coolant through a flexible hose 42. The hose is positioned above the bath so that upward and downward movement is permitted by the flexible hose 42. The hose connects with an elbow 44 which in turn connects with a tee 46. That connects with a detachable lance 48. The lance 48 is detachable so that different lengths of coils can be accommodated as will be explained.

The lance serves in one aspect as a prop for holding the spring 20. In another aspect, the lance is provided with a number of openings at 50. The sum of the cross sectional areas of the openings 50 provides a requisite flow of coolant. The flow of the coolant is matched to the requirements for a particular size spring 20. More importantly, the spring is rested on the lance 48 which is therefore made of a relatively strong metal of sufficient wall thickness that it is not damaged or harmed by the heated coil spring. Furthermore, the lance 48 is positioned on the tee so that the lance extends approximately coaxial with the bath 12. The lance is plugged by a plug 52 at the remote end while the opposite end threads to the tee 46. More will be noted regarding the fluid flow rate of the pump 40 and the openings 50 in describing the device in operation.

A valve assembly 54 is included to deliver hydraulic or pneumatic fluid to the double acting cylinder 32. A control box 56 hangs at an elevation permitting the operator to extend the equipment upwardly or downwardly as required. An upstanding guide rod 60 is also included. Conveniently, it can be grasped and the entire equipment can be pulled to the left or right, riding on the free wheeling trolley 30.

A sensor having the form of a switch is included at 62 and a spaced sensor 64 is likewise included. They are identical in construction and differ only in location. Moreover, the two sensors are used to operate the equipment so that the liquid flow is properly triggered for quenching of the coil spring 20 as will be explained.

In operation, the lance 48 is removed and replaced with a lance which is tailored to a particular coil spring construction. Assume for purposes of illustration that the coil spring 20 is 2 feet in length. In that instance, the lance is at least 2 feet in length and is ideally sufficiently long that the lance extends entirely through the coil spring and positions the openings 50 opposite the coil spring. In this instance, the perforations 50 best span a distance equal to the length of the spring. The lance therefore is provided with perforations at least 24 inches in span and preferably about 26 inches, permitting some excess length at each end. The lance typically must be a minimum of 26 inches but it is preferable that it be about 30–34 inches in length in that event. Greater length is normally not needed. The lance is plugged at one end and is provided with an adequate fluid flow through the set of perforations to provide a specified flow rate directed at the coil spring from the interior. The aggregate flow rate permitted by the perforations 50 matches the flow rate delivered by the pump. This assures that a full flow is delivered at the proper time.

In operation, the control box 56 is operated by the attendant to raise the piston rod and thereby raise all of the equipment out of the bath or tank 12. At this position, the lance is simply hanging in space above the bath 12. The coil spring 20 is shaped on a spring winding machine typified by those presently used in industry. That enables the attendant to move the coil spring from the winding machine and place it on the lance. When placed on the lance, it is typically cherry red hot and attains a temperature of at least 1400° F., sometimes as much as 1700° depending on the nature of the heating step and the particular alloy used in the manufacturing process. The alloy metal is thus heated to this elevated temperature, bent into the coil spring by a spring winding machine and is transferred to the lance hanging above the bath. The equipment is then powered to travel downwardly toward the coolant 14. The upstanding guide bar 60 triggers the switch 62 during downward travel. The switch 62 sends the signal to the pump 40 to start the pump operating to deliver liquid through the hose 42. There is a finite interval required for coolant to flow from the pump 40 to the perforations 50. It is sprayed out through the perforations on the interior of the coil spring. As downward movement continues, the switch 64 is then operated. This stops downward travel. The spacing of the switch 64 in conjunction with the size of the coil spring and the spacing of the cylinder 32 above the bath 12 is determined so that this downward travel properly positions the coil spring submerged in the bath, not in contact with the bottom and not protruding from the surface. Obviously, the tank 12 must have a sufficient quantity of coolant in it to assure that the coil spring is fully submerged. The stopping position is thus determined by the switch 64.

There is a time lag between passing the switch 62 and delivery of the pumped coolant through the perforations 50. This time lag measures typically around a fraction of a second and can be even greater. No particular problem arises from the time lag. It is important however to coordinate this time lag with the time lag required for the double acting cylinder 32 to travel downwardly to actuation of the switch 64 which then stops further downward movement. Thus, as the coil spring is plunged beneath the surface of the coolant 14, the perforations at that instance starts pumping substantial quantities of coolant out through the perforations on the interior of the coil spring. This helps overcome the internal void formed by the vaporized coolant. So to speak, the cylindrical space on the interior of the coil spring becomes an evacuated cylinder at the instant the coil spring is plunged into the coolant bath. Because of the excessive heat release at that moment, all of the liquid on the interior is driven away because of the rapidly expanding gas bubble in that region. Left to its own devices, the coil spring forces the liquid out and no liquid can enter this region until substantial cooling has occurred at which time the liquid collapses the void or bubble formed on the interior and ultimately fills the interior of the coil spring area. When that occurs, the coil spring is then quenched improperly because the coolant liquid is exposed to the interior at a rather late time in the quenching process. That problem is overcome through the use of the present apparatus.

Consider an example of the present invention cooling and quenching a typical partly fabricated coil spring. The stock might readily have a cross section diameter of one or two inches. The spacing between the bights of the coil spring is sufficiently small that the initial exposure to the coolant expels all liquid from inside the coil spring 20. The pump 40 is operated to deliver a coolant flow at a specified rate dependent on the coil spring volume. This is delivered through the perforations 50 beginning at about the instant the coil spring plunges beneath the surface of the coolant 14. Moreover, this is accomplished so that the coil spring is exposed to coolant on the interior in contact with the inside face without any further effort because it is brought in contact with the coolant. The bubbles which are formed on the interior from vaporization provide a hold up of perhaps a fraction of a second to perhaps greater than one second depending on a number of scale values. The spray delivered from the lance on the interior replenishes the volumetric quantity of liquid on the interior, thereby overcoming the propensity to badly delay quenching of the inside face. Especially where the coil material is relatively thick, e.g., one inch or greater in diameter, this delayed cooling at the inside face creates areas of improper heat treat, weakening the spring and cutting the life of the spring seriously. It is not uncommon for a spring to fail early in the life of the coil spring when installed in industrial equipment. In this instance, the coil spring is quenched evenly from all sides.

The foregoing describes the apparatus and also sets out a method of application. As will be understood this equipment is particular useful for continued mass production of coil springs. The coolant tank and illustrated equipment of the present disclosure are preferably installed within a few feet of the coil winding machine. This enables ready transfer with a pair of long tongs from the coil winding machine onto the lance 48 for cooling. Obviously, changes in scale can be accommodated in the present disclosure.

As described to this juncture, the system is substantially operator controlled. In that sense, the hydraulic cylinder 32 is operated under control of the operator. As will be understood, this is an acceptable mode of operation in many instances. There are times however when the system can be enhanced by operating automatically. As disclosed below, an apparatus is set forth which provides automatic operation. In part, this utilizes an oil heater 70 which is shown with lines connected to and from the tank of coolant. The oil which is circulated in the system typically must be heated to a selected temperature. It is however a temperature which is controlled as will be set forth. While the oil in the tank is heated by liberation of heat from the coil spring 20, that liberated heat typically is not enough to maintain a controlled temperature for the oil bath. Therefore at least at startup or perhaps later, the system must be provided with oil which is heated to a desired temperature. Thus, an oil heater 70 is included. In addition the heater 70 cooperates with a thermometer 72 which has a probe 74 extending into the oil bath. The probe is incorporated for the purpose of measuring the temperature of the oil. The probe 74 is connected to the thermometer 72 to make measurements of oil temperature.

The system also includes a timer 76 which is connected to the valve assembly 54 to operate the valve assembly. In that instance, the valve controlling the flow of hydraulic oil to the cylinder 32 is made subject to control of the timer. This enables the duration of quenching to be controlled when this is in control of system operation while the switch 56 is simply operated to initiate downward movement. But the upward return which pulls the partly treated spring from the coolant is initiated by the timer 76. The timer 76 connects with a controller 80 which has an output to the control switches 56 for the above mentioned purpose. The controller 80 is thus provided with an input from the timer 76 to complete this control pathway. In addition to that, the controller likewise enables the operator to input a desired temperature. The temperature is input to the controller 80 which then forms a control signal to the oil heater 70. That completes the control loop for assuring that the temperature is raised to the desired level. In summary, the control system enables completely automatic control for the user. This reduces the complexity of the operational steps. Since the operator is quite busy handling the cherry red hot spring 20 which must be moved from other manufacturing equipment to be placed on the lance 48, and since the cooled spring 20 must thereafter be moved to another part of the manufacturing equipment, the sequence of operations placed on the operator are simplified through the use of the automatic control system. As will be understood, the entire system can be operated manually if desired.

While the foregoing is directed to the preferred embodiment, the scope is determined by the claims which follow.

I claim:

1. An apparatus for quenching a coil spring during fabrication after the coil spring is heated, the quenching apparatus comprising:

(a) a tank for coolant having a specified depth;

(b) an overhead traveling lance moving upwardly and downwardly wherein upward movement positions said lance above the coolant in the tank and downward movement positions said lance in the coolant;

(c) a pump operable to deliver through a feed line a flow of coolant liquid into the lance wherein the lance incorporates an outlet directing flowing coolant from the pump to the inside face of a coil spring supported on the lance; and (d) wherein said lance delivers a flow of coolant to the inside face of the heated coil spring while submerging the coil spring in the coolant to thereby overcome the tendency of the coolant to form a vaporized bubble of coolant on the coil spring interior against the inside face of the coil spring.

2. The apparatus of claim 1 wherein said tank is an elongate tank having a lengthwise coolant flow from a tank pump.

3. The apparatus of claim 2 wherein said lance is supported over said tank on a movable trolley positioning said lance above said tank and also displaced from said tank.

4. The apparatus of claim 3 wherein said trolley moves along an overhead trolley supporting member.

5. The apparatus of claim 1 wherein said lance is supported below a double acting fluid powered cylinder to raise or lower said lance.

6. The apparatus of claim 5 wherein said cylinder is a vertical, double acting fluid powered cylinder moving a piston rod so that said lance is raised or lowered; and wherein said lance is supported on a means supported by said cylinder and including a lance connection to a lance feed line.

7. The apparatus of claim 6 wherein said lance comprises a removable hollow tube having plural perforations to direct flowing coolant to the inside face of the coil spring.

8. The apparatus of claim 1 wherein said lance comprises a removable hollow tube having plural perforations to direct flowing coolant to the inside face of the coil spring.

9. The apparatus of claim 8 wherein said lance perforations are distributed along a length of said lance equal to or slightly greater in length than the coil spring supported on said lance.

10. The apparatus of claim 9 wherein said lance perforations are equal in cross sectional area to the feed line, and said perforations direct coolant in all directions.

11. The apparatus of claim 10 wherein a timer controls the time of cooling the coil spring.

12. An apparatus for quenching a coil spring during fabrication after the coil spring is heated, the quenching apparatus comprising:

(a) a tank for coolant having a specified depth;

(b) an overhead lance supporting a coil spring and moving upwardly and downwardly wherein upward movement positions said lance above the coolant in the tank and downward movement positions a coil spring on said lance in the coolant;

(c) a pump operable to deliver pumped coolant from said lance wherein the lance directs pumped coolant to the inside face of the coil spring supported on the lance; and (d) wherein said lance delivers coolant to the inside face of the heated coil spring while submerging the coil spring in the coolant to thereby overcome the tendency of the coolant to form a vaporized bubble of coolant on the coil spring interior against the inside face of the coil spring.

13. The apparatus of claim 12 wherein said tank is an elongate tank having a lengthwise coolant flow from a tank pump; and said lance is supported over said tank on a movable trolley positioning said lance above said tank and also displaced from said tank.

14. The apparatus of claim 13 wherein said lance is moved by a double acting fluid powered cylinder to raise or lower said lance.

15. The apparatus of claim 14 wherein said cylinder is a vertical, double acting fluid powered cylinder moving a piston rod so that said lance is raised or lowered; and wherein said lance is supported on a means supported by said cylinder and including a lance connection to a lance feed line.

16. The apparatus of claim 15 wherein said lance comprises a removable hollow tube having plural perforations to direct flowing coolant to the inside face of the coil spring.

17. The apparatus of claim 12 wherein said lance comprises a removable hollow tube having plural perforations to direct flowing coolant to the inside face of the coil spring; and said lance perforations are distributed along a length of said lance equal to or slightly greater in length than the coil spring supported on said lance; and said lance perforations are equal in cross sectional area to the feed line, and said perforations direct coolant in all directions.

* * * * *